US011306535B2

(12) United States Patent
Lu

(10) Patent No.: US 11,306,535 B2
(45) Date of Patent: Apr. 19, 2022

(54) PRE-LOADABLE SPRING ROLLER BLIND

(71) Applicant: Ningbo Zhenfei Decorated Curtain Co., Ltd., Zhejiang Province (CN)

(72) Inventor: Jiefei Lu, Zhejiang Province (CN)

( * ) Notice: Subject to any disclaimer, the term of this patent is extended or adjusted under 35 U.S.C. 154(b) by 0 days.

(21) Appl. No.: 17/460,300

(22) Filed: Aug. 29, 2021

(65) Prior Publication Data

US 2022/0090446 A1 Mar. 24, 2022

(51) Int. Cl.
*E06B 9/60* (2006.01)
*E06B 9/42* (2006.01)

(52) U.S. Cl.
CPC . *E06B 9/60* (2013.01); *E06B 9/42* (2013.01)

(58) Field of Classification Search
CPC ..... E06B 9/60; E06B 9/42; E06B 9/56
USPC ..... 160/305
See application file for complete search history.

(56) References Cited

U.S. PATENT DOCUMENTS 9,631,425 B2 * 4/2017 Campagna ..... E06B 9/60
10,221,622 B2 * 3/2019 Campagna ..... E06B 9/60
10,364,602 B2 * 7/2019 Kwak ..... E06B 9/50
10,450,798 B2 * 10/2019 Anthony ..... E06B 9/42
10,501,988 B2 * 12/2019 Fisher ..... E06B 9/62
10,753,148 B2 * 8/2020 Jay ..... E06B 9/88
2014/0216666 A1 * 8/2014 Smith ..... E06B 9/322 160/84.04
2016/0010390 A1 * 1/2016 Smith ..... E06B 9/78 160/302

FOREIGN PATENT DOCUMENTS

DE 202021102902 U1 * 6/2021 ..... E06B 9/80

* cited by examiner

*Primary Examiner* — Beth A Stephan
(74) *Attorney, Agent, or Firm* — Prakash Nama; Global IP Services, PLLC

(57) ABSTRACT

A pre-loadable spring roller blind, including a spring bar, a limiting spring, a spring tail plug and a limiting pipe plug sleeve. By arranging the spring tail plug into the first rotating plug and the first adjusting core and arranging the holding spring between the first rotating plug and the first adjusting core, the first adjusting core can be rotated to store the force for the limiting spring. After the torsion force is stored, the spring may not discharge the force when released. When the limiting pipe plug sleeve is used for loading, as long as the tail of the spring bar is fixed, the limiting pipe plug sleeve is rotated to store a force for the limiting spring. After the force is stored, the limiting pipe plug sleeve can be released at any time and the limiting pipe plug sleeve is kept fixed.

10 Claims, 3 Drawing Sheets

PRE-LOADABLE SPRING ROLLER BLIND

BACKGROUND OF THE INVENTION

The present invention relates to a spring roller blind, and in particular to a pre-loadable spring roller blind.

The existing spring roller blind generally comprises a first side bracket, a second side bracket corresponding to the first side bracket, a scroll having both ends respectively fixed to the first side bracket and the second side bracket, a spring bar arranged in the scroll, a limiting spring sleeved outside the spring bar and located in the scroll, and a spring tail plug fixed with the limiting spring and located in the scroll. The first end of the spring bar is connected with the first side bracket through a ratchet wheel connecting structure, and the first end of the spring bar is connected with the spring tail plug. The tension of the limiting spring is determined by a distance between the spring tail plug and the first side bracket. Therefore, when the whole spring roller blind is produced, the tension of the limiting spring is fixed and cannot be adjusted and changed by a user as required.

For this, the applicant proposes a spring roller blind which is adjustable in tension. Specifically, the patent for present invention with application No. 201420090112.6 can be seen. The user can adjust the tension of the limiting spring as required. However, when the spring tension is adjusted in the spring roller blind which is adjustable in tension, the spring must be placed inside the scroll to load a torsion force, which is not convenient to adjust. Moreover, after the spring is taken out from the scroll, the torsion force of the spring is removed, and the torsion force needs to be reset, which will increase the working strength of the user.

BRIEF SUMMARY OF THE INVENTION

A technical problem to be solved by the present invention is to provide a pre-loadable spring roller blind to solve the problem that the existing spring roller blind can only store a force in a scroll.

A technical solution adopted to solve the above technical problems in the present invention is as follows:

A pre-loadable spring roller blind comprises a spring bar, a limiting spring sleeved on the outer side of the spring bar, a spring tail plug and a limiting pipe plug sleeve; the spring tail plug comprises a first rotating plug, a first adjusting core and a holding spring; the first rotating plug is sleeved at the tail of the spring bar; the first rotating plug is fixedly connected with the tail of the limiting spring; the spring bar and the first rotating plug are provided with limiting structures for preventing the first rotating plug from sliding toward the head of the spring bar; the inner wall of the first rotating plug is transversely provided with a first positioning component; a cavity with an opening that faces the tail of the spring bar is annularly reserved between the first rotating plug and the spring bar; and the first rotating plug has a degree of freedom for rotation relative to the spring bar.

The holding spring is sleeved on the spring bar; the holding spring and the spring bar are in interference fit; the holding spring is located in the cavity; both ends of the holding spring are respectively provided with two first lead-out parts; the first positioning component is transversely arranged between the two first lead-out parts; the first lead-out part on the left of the first positioning component has a degree of freedom for holding with the spring bar in a counterclockwise direction; and the first lead-out part on the right of the first positioning component has a degree of freedom for holding with the spring bar in a clockwise direction. When a rotating force in either clockwise or counterclockwise direction is applied to the first positioning component, the first lead-out parts are pushed by the positioning component to strengthen the holding with the spring bar, to prevent the first positioning component from rotating.

The first adjusting core comprises a second limiting part, and a toggle part connected with the second limiting part; the second limiting part is sleeved at the tail of the spring bar; the toggle part is transversely inserted between the two first lead-out parts of the holding spring; the first lead-out part on the left of the toggle part has a degree of freedom for driving the holding spring to spin off the spring bar in the clockwise direction; and the first lead-out part on the right of the toggle part has a degree of freedom for driving the holding spring to spin off the spring bar in the counterclockwise direction. the second limiting part and the toggle part have a degree of freedom of rotation relative to the spring bar; when a rotating force in either clockwise or counterclockwise direction is applied to the first adjusting core, the holding spring is pushed by the toggle part to reduce the holding with the spring bar, so that the first rotating plug rotates with the holding spring.

The head of the spring bar is fixedly connected with a screw rod arranged coaxially; the limiting pipe plug sleeve is sleeved on the outer side of the screw rod, and is fixedly connected with the head of the limiting spring; an adjusting nut is arranged between the limiting pipe plug sleeve and the screw rod; the adjusting nut is in threaded connection with the screw rod; and the adjusting nut moves along the axial direction of the limiting pipe plug sleeve and can rotate synchronously with the limiting pipe plug sleeve.

Preferably, the tail of the spring bar is coaxially and fixedly connected with a connecting rod, and the outer diameter of the connecting rod is less than the outer diameter of the spring bar; the spring tail plug is arranged on the connecting rod; the first rotating plug of the spring tail plug is annularly provided with a first limiting part for preventing the first rotating plug from sliding toward the head of the spring bar; and the first limiting part is in clearance fit with the connecting rod.

Preferably, the spring tail plug is provided with an external thread, and the tail of the limiting spring is sleeved outside the external thread and fixedly connected with the external thread.

Preferably, the limiting pipe plug sleeve is provided with an external thread, and the head of the limiting spring is sleeved outside the external thread and fixedly connected with the external thread.

Preferably, the outer side surface of the second limiting part is provided with at least one limiting surface for the convenience of rotating the second limiting part with a wrench to store a force for the limiting spring.

Preferably, a limiting component is arranged between the screw rod and the limiting pipe plug sleeve; and the limiting component is used for limiting the limiting pipe plug sleeve in a position on the screw rod so that the limiting pipe plug sleeve can only rotate along the screw rod.

Preferably, a clamping block is arranged on the outer side surface of the adjusting nut; the inner side wall of the limiting pipe plug sleeve is correspondingly provided with a chute which extends along the axial direction; and the clamping block is located in the chute and can slide along the chute.

Preferably, the spring roller blind also comprises a rotating mechanism, a scroll, and a left bracket and a right bracket which are located on both ends of the scroll and opposite to each other; the head of the spring bar is connected with the left bracket for preventing the spring bar from rotating; the rotating mechanism is installed on the right bracket; the scroll is sleeved on the outer side of a roller blind mechanism composed of the spring bar, the limiting spring, the spring tail plug and the limiting pipe plug sleeve, and the rotating mechanism; and the winding or unfolding of curtain cloth on the outer side of the scroll is controlled by the roller blind mechanism and the rotating mechanism.

Preferably, the roller blind mechanism also comprises a decelerator; the decelerator is located at the tail of the spring bar; and the decelerator comprises:

a main body, wherein a connecting piece is arranged on one side of the main body, the tail of the spring bar is fixedly connected with the connecting piece and an accommodating cavity is arranged on the other side of the main body;

a second adjusting core, wherein part of the second adjusting core is located in the accommodating cavity of the main body;

a sealing cover which is provided with a through hole, wherein part of the second adjusting core penetrates through the through hole and hermetically installs the other part of the second adjusting core in the accommodating cavity;

a second rotating plug which is provided with a penetrating hole, wherein part of the second adjusting core that extends from the accommodating cavity penetrates through the penetrating hole through a bolt and is connected with the second rotating plug; a cylindrical positioning component is arranged in the second rotating plug; the positioning component is provided with a positioning groove; and the outer wall of the second rotating plug is in interference fit with the scroll;

a torsion spring sleeved on the outer side of the second adjusting core, wherein the end of the torsion spring is provided with a second lead-out part and the second lead-out part is clamped in the positioning groove of the second rotating plug.

Preferably, the spring bar and the connecting piece are fixed through pin shafts or screws.

Preferably, the left bracket is provided with a positioning column; the head of the spring bar is provided with a positioning groove; and the positioning column is inserted into the positioning groove for preventing the spring bar from rotating.

Preferably, the positioning groove is cross for connecting a motor to realize electric loading.

Compared with the prior art, the present invention has the beneficial effects:

Through arrangement of the limiting pipe plug sleeve, as long as the tail of the spring bar is fixed, the limiting pipe plug sleeve is rotated to store a force for the limiting spring. After the force is stored, the limiting pipe plug sleeve can be released at any time and the limiting pipe plug sleeve is kept fixed due to the threaded fit of the adjusting nut and the screw rod, i.e., the spring roller blind can individually store the force for the limiting spring. After a torsion force is stored, the spring may not discharge the force when released.

By arranging the spring tail plug into the first rotating plug and the first adjusting core and arranging the holding spring between the first rotating plug and the first adjusting core, the first adjusting core can be rotated to store the force for the limiting spring. After the torsion force is stored, due to the action of the holding spring, the spring may not discharge the force when released, so as to optimize force loading and adjustment.

Reference signs: 11 spring bar; 111 screw rod; 112 annular limiting groove; 113 positioning groove; 12 limiting spring; 13 spring tail plug; 131 first rotating plug; 1311 first positioning component; 132 first adjusting core; 1321 toggle part; 1322 second limiting part; 14 limiting pipe plug sleeve; 141 limiting bolt; 142 chute; 15 adjusting nut; 151 clamping block; 2 rotating mechanism; 3 left bracket; 31 positioning column; 4 right bracket; 5 decelerator; 51 main body; 511 connecting piece; 512 connecting hole; 52 second adjusting core; 53 sealing cover; 54 second rotating plug; 541 second positioning component; 542 positioning groove; 55 torsion spring; 551 second lead-out part; 56 screw.

DETAILED DESCRIPTION OF THE INVENTION

The present invention is further described below in detail in combination with the drawings and embodiments.

Figure 1:
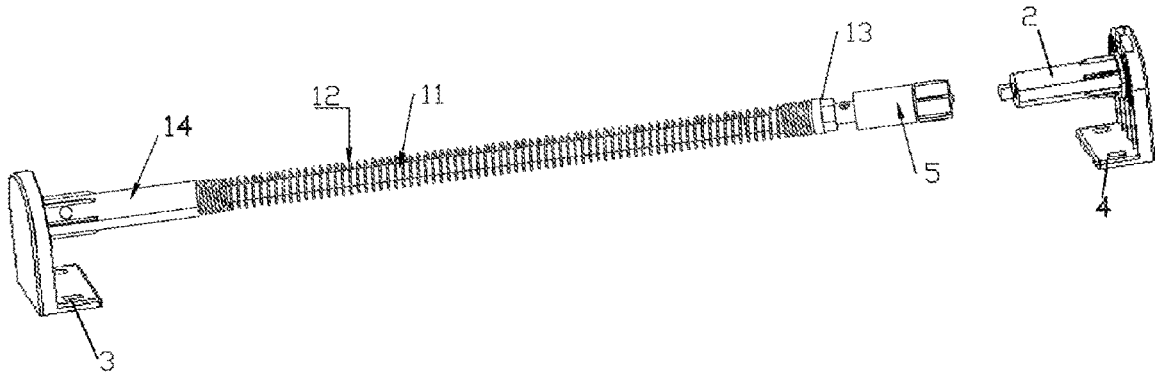
FIG. 1 is a structural schematic diagram of a pre-loadable spring roller blind in the present embodiment.
Figure 2:
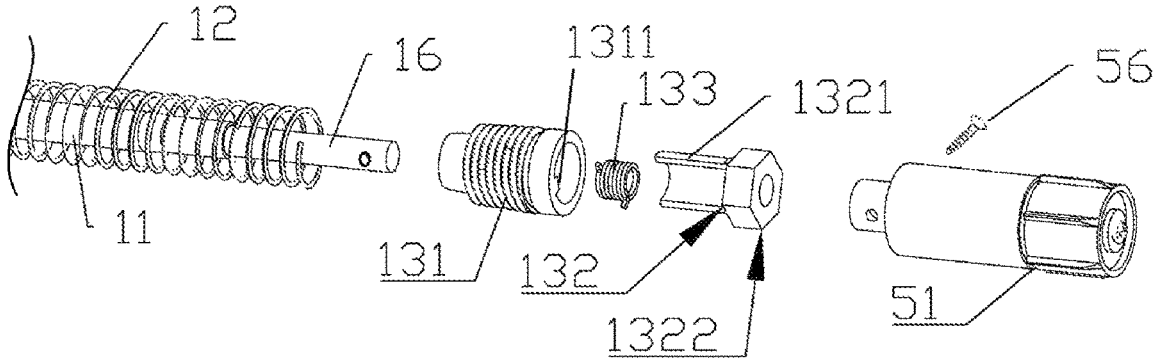
FIG. 2 is an exploded schematic diagram of a connecting structure of a spring tail plug of a pre-loadable spring roller blind in the present embodiment.

A pre-loadable spring roller blind, as shown in FIG. 1, comprises a spring bar 11, a limiting spring 12 sleeved on the outer side of the spring bar 11, a spring tail plug 13, a limiting pipe plug sleeve 14, a rotating mechanism 2, a decelerator 5, a scroll, and a left bracket 3 and a right bracket 4 which are located on both ends of the scroll and opposite to each other. As shown in FIG. 2, the spring tail plug 13 comprises a first rotating plug 131, a first adjusting core 132 and a holding spring 133; the first rotating plug 131 is sleeved at the tail of the spring bar 11; the first rotating plug 131 is provided with an external thread, and the tail of the limiting spring 12 is sleeved outside the external thread and fixedly connected with the external thread. The spring bar 11 and the first rotating plug 131 are provided with limiting structures for preventing the first rotating plug 131 from sliding toward the head of the spring bar 11.

In the present embodiment, the spring bar 11 comprises a connecting rod 16 coaxially connected to the tail, and the outer diameter of the connecting rod 16 is less than the outer diameter of the spring bar 11. The first rotating plug 131 is sleeved on the connecting rod 16; a first limiting part is annularly arranged inside the first rotating plug 131; the first limiting part is in clearance fit with the connecting rod 16; and the first limiting part is used for preventing the first rotating plug 131 from sliding toward the head of the spring bar 11. The inner wall of the first rotating plug 131 is transversely provided with a first positioning component 1311; a cavity with an opening that faces the tail of the connecting rod 16 is annularly reserved between the first rotating plug 131 and the connecting rod 16; and the first rotating plug 131 has a degree of freedom for rotation relative to the spring bar 11.

A holding spring 133 is sleeved on the connecting rod 16; the holding spring 133 and the connecting rod 16 are in interference fit; the holding spring 133 is located in the cavity; both ends of the holding spring 133 are respectively provided with two first lead-out parts; the first positioning component 1311 is transversely arranged between the two first lead-out parts; the first lead-out part on the left of the first positioning component 1311 has a degree of freedom for holding with the connecting rod 16 in a counterclockwise direction; and the first lead-out part on the right of the first positioning component 1311 has a degree of freedom for holding with the connecting rod 16 in a clockwise direction. When a rotating force in either clockwise or counterclockwise direction is applied to the first positioning component 1311, the first lead-out parts are pushed by the positioning component 1311 to strengthen the holding with the connecting rod 16, to prevent the first positioning component 1311 from rotating.

The first adjusting core 132 comprises a second limiting part 1322, and a toggle part 1321 connected with the second limiting part 1322; the second limiting part 1322 is sleeved at the tail of the connecting rod 16; the toggle part 1321 is transversely inserted between the two first lead-out parts of the holding spring 133; the first lead-out part on the left of the toggle part 1321 has a degree of freedom for driving the holding spring 133 to spin off the connecting rod 16 in the clockwise direction; and the first lead-out part on the right of the toggle part has a degree of freedom for driving the holding spring 133 to spin off the connecting rod 16 in the counterclockwise direction; the second limiting part 1322 and the toggle part 1321 have a degree of freedom of rotation relative to the connecting rod 16; when a rotating force in either clockwise or counterclockwise direction is applied to the first adjusting core 132, the holding spring 133 is pushed by the toggle part 1321 to reduce the holding with the connecting rod 16; the holding spring 133 rotates relative to the connecting rod 16 so that the first rotating plug 131 rotates with the holding spring 133, to drive the limiting spring 12 to rotate and store the force for the limiting spring 12.

The outer side surface of the second limiting part 1322 is provided with at least one limiting plane. In the present embodiment, the second limiting part 1322 has a shape of a hexagonal nut for the convenience of rotating the second limiting part 1322 with a clip to store the force for the spring tail plug 13.

When the force is adjusted for the limiting spring 12 through the spring tail plug 13, the head of the spring bar 11 is fixed, and the second limiting part 1322 is twisted with a wrench or with hands. The second limiting part 1322 drives the toggle part 1321 to apply a force for the first lead-out part of the holding spring 133 to spin off the connecting rod 16, and the holding force of the holding spring 133 and the connecting rod 16 is reduced. The holding spring 133 rotates around the connecting rod 16, so that the first rotating plug 131 and the limiting spring 12 rotate with the holding spring 133, so as to store the force for the limiting spring 12. After the force is stored, the limiting spring 12 applies a rotating force in the opposite direction to the first rotating plug 131. The first lead-out parts of the holding spring 133 are pushed by the positioning component 1311 to strengthen the holding with the connecting rod 16, to prevent the first positioning component 1311 and the first rotating plug 131 from rotating. Therefore, after the torsion force is stored, due to the action of the holding spring 133, the spring may not discharge the force when released, so as to optimize force loading and adjustment.

Figure 4:
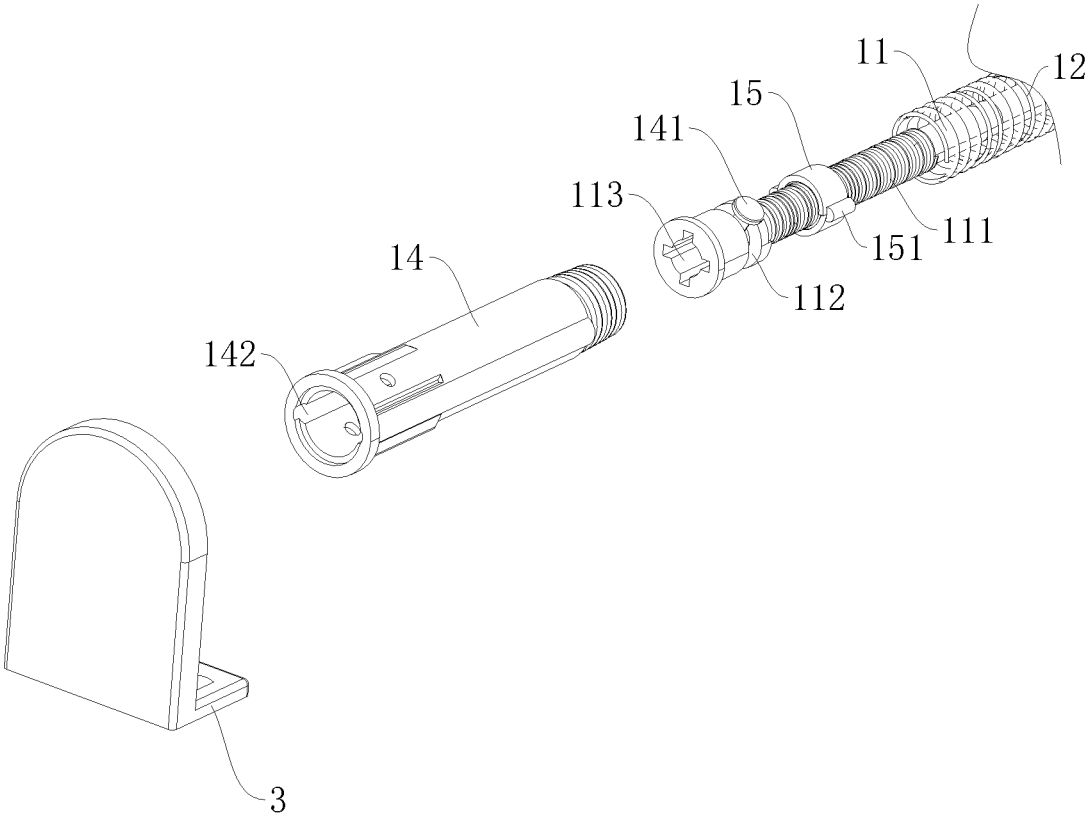
FIG. 4 is an exploded schematic diagram of a connecting structure of a limiting pipe plug sleeve of a pre-loadable spring roller blind in the present embodiment.

As shown in FIG. 4, the head of the spring bar 11 is fixedly connected with a screw rod 111 arranged coaxially; the limiting pipe plug sleeve 14 is sleeved on the outer side of the screw rod 111, and is provided with an external thread; the head of the limiting spring 12 is sleeved outside the external thread and fixedly connected with the external thread; an adjusting nut 15 is arranged between the limiting pipe plug sleeve 14 and the screw rod 111; the adjusting nut 15 is in threaded connection with the screw rod 111; and the adjusting nut 15 moves along the axial direction of the limiting pipe plug sleeve 14 and can rotate synchronously with the limiting pipe plug sleeve 14.

A clamping block 151 is arranged on the outer side surface of the adjusting nut 15; the inner side wall of the limiting pipe plug sleeve 14 is correspondingly provided with a chute 142 which extends along the axial direction; and the clamping block 151 is located in the chute 142 and can slide along the chute 142.

Specifically, a limiting component is arranged between the screw rod 111 and the limiting pipe plug sleeve 14; and the limiting component is used for limiting the limiting pipe plug sleeve 14 in a position on the screw rod 111 so that the limiting pipe plug sleeve 14 can only rotate along the screw rod 111. The limiting component comprises an annular limiting groove 112 arranged on the screw rod 111 and a limiting bolt 141 passing radially through the limiting pipe plug sleeve 14; and the limiting bolt 141 extends into the annular limiting groove 112, so as to limit the position of the limiting pipe plug sleeve 14 on the screw rod 111 to prevent the limiting pipe plug sleeve 14 from moving along the axial direction of the screw rod 111.

Through the limiting pipe plug sleeve 14, when the force is stored for the limiting spring 12, as long as the tail of the spring bar 11 is fixed, the spring bar 11 can be fixed by manual holding or by a clip; and the limiting pipe plug sleeve 14 is rotated to store the force for the limiting spring 12. Then, the tail of the spring bar 11 is connected with the decelerator 5. After assembly, the limiting pipe plug sleeve 14 can be released at any time and the limiting pipe plug sleeve 14 is kept fixed due to the threaded fit of the adjusting nut 15 and the screw rod 111, i.e., the spring roller blind can individually store the force for the limiting spring 12. After a torsion force is stored, the spring may not discharge the force even if the scroll is not installed.

As shown in FIG. 1, the spring bar 11 is connected with the left bracket 3 for fixing the spring bar 11. The rotating mechanism 2 is installed on the right bracket 4. The scroll is sleeved on the outer side of a roller blind mechanism composed of the spring bar 11, the limiting spring 12, the spring tail plug 13 and the limiting pipe plug sleeve 14, and the rotating mechanism 2; and the winding or unfolding of curtain cloth on the outer side of the scroll is controlled by the rotating mechanism 2 and the roller blind.

Figure 5:
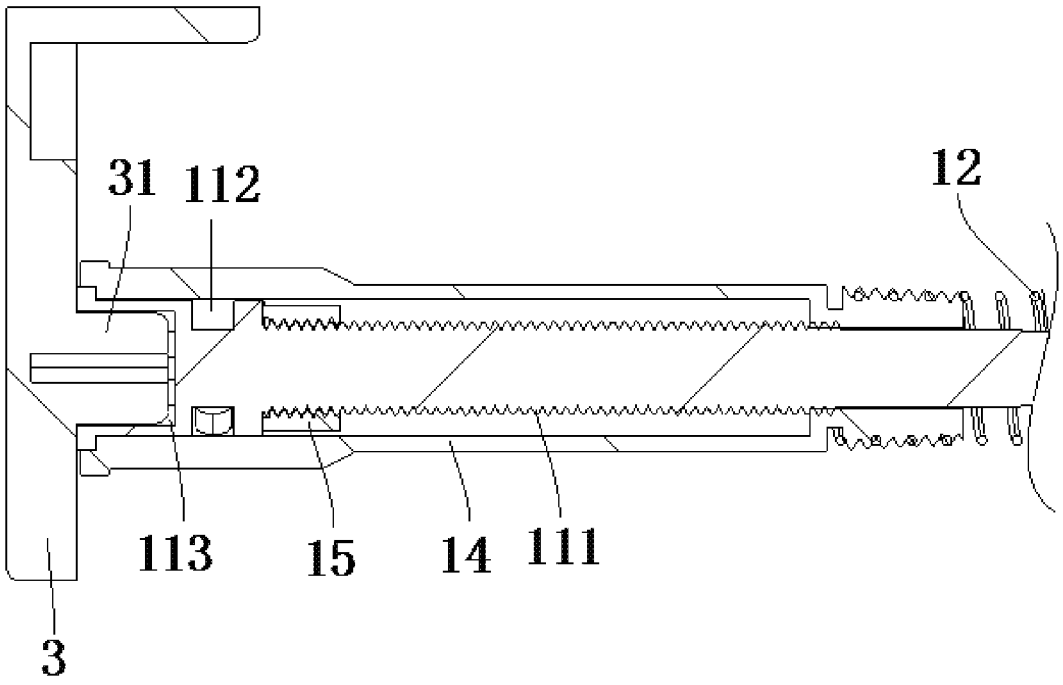
FIG. 5 is a sectional view of a connecting structure of a limiting pipe plug sleeve of a pre-loadable spring roller blind in the present embodiment.

As shown in FIG. 5, the left bracket 3 is provided with a positioning column 31; the head of the spring bar 11 is provided with a positioning groove 113; and the positioning column 31 is inserted into the positioning groove 113 for fixing the spring bar 11 and preventing the spring bar 11 from rotating.

The curtain cloth is pulled to stop the curtain cloth at any position, which is achieved by the rotating mechanism 2, and specifically by a steel ball arranged in the rotating mechanism 2 and clamped in a different position. The rotating mechanism 2 is a conventional technical means in this field.

Figure 3:
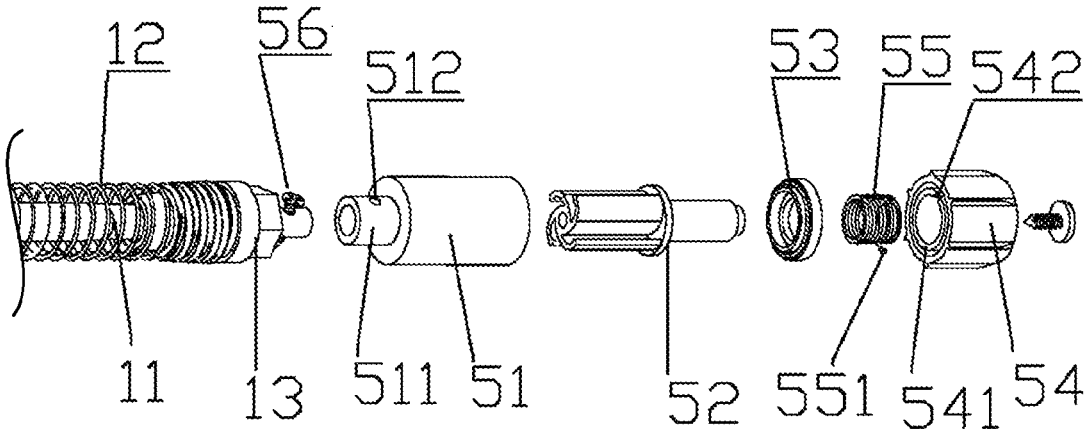
FIG. 3 is an exploded schematic diagram of a connecting structure of a decelerator of a pre-loadable spring roller blind in the present embodiment.

As shown in FIG. 3, the roller blind mechanism also comprises a decelerator 5; the decelerator 5 is located at the tail of the connecting rod 16; and the decelerator 5 comprises: a main body 51, wherein a connecting piece 511 is arranged on one side of the main body, the connecting piece is an inserting cylinder, the tail of the connecting rod 16 is inserted into the inserting cylinder 511, the side wall of the inserting cylinder is provided with a connecting hole 512 in a penetrating mode, the tail of the connecting rod 16 is provided with a connecting hole, the main body is connected with the connecting rod 11 through a fastener 56, the fastener is a screw, and an accommodating cavity is arranged on the other side of the main body 51;

a second adjusting core 52, wherein part of the second adjusting core 52 is located in the accommodating cavity of the main body 51;

a sealing cover 53 which is provided with a through hole, wherein part of the second adjusting core 52 penetrates through the through hole and hermetically installs the other part of the second adjusting core 52 in the accommodating cavity;

a second rotating plug 54 which is provided with a penetrating hole, wherein part of the second adjusting core 52 that extends from the accommodating cavity penetrates through the penetrating hole through a bolt and is connected with the second rotating plug 54; a cylindrical positioning component 541 is arranged in the second rotating plug 54; the positioning component 541 is provided with a positioning groove 542; and the outer wall of the second rotating plug 54 is in interference fit with the scroll;

a torsion spring 55 sleeved on the outer side of the second adjusting core 52, wherein the end of the torsion spring is provided with a second lead-out part 551 and the second lead-out part 551 is clamped in the positioning groove 542 of the second rotating plug 54.

In use, when the curtain cloth is unfolded, the curtain cloth is directly pulled down by hands and stopped after pulled to an appropriate position. In this process, the screw rod 111 does not move, the adjusting nut 15 rotates synchronously with the scroll in the limiting pipe plug sleeve 14, and the adjusting nut 15 moves to the right along the screw rod 111. When the curtain cloth is rolled, the curtain cloth is pulled down a little, and then released. The curtain cloth is rolled automatically. The adjusting nut 15 moves to the left along the screw rod 111 to the initial position and then stop, so that the curtain cloth returns to the initial position.

Although preferred embodiments of the present invention are described in detail above, it should be clearly understood that for those skilled in the art, various variations and changes can be made to the present invention. Any modification, equivalent replacement and improvement made within the spirit and the principle of the present invention shall be included within the protection scope of the present invention.

What is claimed is:

1. A pre-loadable spring roller blind, comprising a spring bar (11), a limiting spring (12) sleeved on an outer side of the spring bar (11), a spring tail plug (13) and a limiting pipe plug sleeve (14), wherein the spring tail plug (13) comprises a first rotating plug (131), a first adjusting core (132) and a holding spring (133); the first rotating plug (131) is sleeved at a tail of the spring bar (11); the first rotating plug (131) is fixedly connected with a tail of the limiting spring (12); the spring bar (11) and the first rotating plug (131) are provided with limiting structures for preventing the first rotating plug (131) from sliding toward a head of the spring bar 11); an inner wall of the first rotating plug (131) is transversely provided with a first positioning component (1311); a cavity with an opening that faces the tail of the spring bar (11) is located between the first rotating plug (131) and the spring bar (11); and the first rotating plug (131) has a degree of freedom for rotation relative to the spring bar (11);

the holding spring (133) is sleeved on the spring bar (11); the holding spring (133) and the spring bar (11) are in interference fit; the holding spring (133) is located in the cavity; ends of the holding spring (133) are each provided with a lead-out part; the first positioning component (1311) is transversely arranged between the lead-out parts; one of the lead-out parts on a left of the first positioning component (1311) has a degree of freedom for holding with the spring bar (11) in a counterclockwise direction; and the other of the lead-out parts on a right of the first positioning component (1311) has a degree of freedom for holding with the spring bar (11) in a clockwise direction;

the first adjusting core (132) comprises a second limiting part (1322), and a toggle part (1321) connected with the second limiting part (1322); the second limiting part (1322) is sleeved at the tail of the spring bar (11); the toggle part (1321) is transversely inserted between the two lead-out parts of the holding spring (133); the lead-out part on a left of the toggle part has a degree of freedom for driving the holding spring (133) to spin off the spring bar (11) in the clockwise direction; and the if-sl-lead-out part on a right of the toggle part has a degree of freedom for driving the holding spring (133) to spin off the spring bar (11) in the counterclockwise direction; the second limiting part (1322) and the toggle part (1321) have a degree of freedom of rotation relative to the spring bar (11);

the head of the spring bar (11) is fixedly connected with a screw rod (11) arranged coaxially; the limiting pipe plug sleeve (14) is sleeved on an outer side of the screw rod (111), and is fixedly connected with MA head of the limiting spring (12); an adjusting nut (15) is arranged between the limiting pipe plug sleeve (14) and the screw rod (111); the adjusting nut (15) is in threaded connection with the screw rod (111); and the adjusting nut (15) moves along an axial direction of the limiting pipe plug sleeve (14) and being rotatable synchronously with the limiting pipe plug sleeve (14).

2. The pre-loadable spring roller blind according to claim 1, wherein the tail of the spring bar (11) is coaxially and fixedly connected with a connecting rod (16), and an outer diameter of the connecting rod (16) is less than an outer diameter of the spring bar (11): the spring tail plug (13) is arranged on the connecting rod (16); the first rotating plug (131) of the spring tail plug (13) is annularly provided with a first limiting part for preventing the first rotating plug (131) from sliding toward the head of the spring bar (11); and the first limiting part is in clearance fit with the connecting rod.

3. The pre-loadable spring roller blind according to claim 1, wherein the first rotating plug (131) is provided with an external thread, and a tail of the limiting spring (12) is sleeved outside the external thread and fixedly connected with the external thread.

4. The pre-loadable spring roller blind according to claim 1, wherein the limiting pipe plug sleeve (14) is provided with an external thread, and the head of the limiting spring (12) is sleeved outside the external thread and fixedly connected with the external thread.

5. The pre-loadable spring roller blind according to claim 1, wherein an outer side surface of the second limiting part (1322) is provided with at least one limiting surface.

6. The pre-loadable spring roller blind according to claim 1, further comprising a rotating mechanism (2), a scroll, and a left bracket (3) and a right bracket (4) which are located on both ends of the scroll and opposite to each other; the head of the spring bar (11) is connected with the left bracket (3)

for preventing the spring bar (11) from rotating; the rotating mechanism (2) is installed on the right bracket (4); the scroll is sleeved on an outer side of a roller blind mechanism composed of the spring bar (11), the limiting spring (12), the spring tail plug (13) and the limiting pipe plug sleeve (14), and the rotating mechanism (2); and the winding or unfolding of curtain cloth on an outer side of the scroll is controlled by the roller blind mechanism and the rotating mechanism (2).

7. The pre-loadable spring roller blind according to claim 1, wherein a clamping block (151) is arranged on an outer side surface of the adjusting nut (15); an inner side wall of the limiting pipe plug sleeve (14) is correspondingly provided with a chute (142) which extends along the axial direction of the limiting pipe plug sleeve (14); and the clamping block (151) is located in the chute (142) and being slidable along the chute (142).

8. The pre-loadable spring roller blind according to claim 1, wherein a limiting component is arranged between the screw rod (111) and the limiting pipe plug sleeve (14); and the limiting component limits the limiting pipe plug sleeve (14) in a position on the screw rod (111) so that the limiting pipe plug sleeve (14) is rotatable only along the screw rod (111).

9. The pre-loadable spring roller blind according to claim 8, wherein the roller blind mechanism also comprises a decelerator (5); the decelerator (5) is located at the tail of the spring bar (11); and the decelerator (5) comprises:

a main body (51), wherein a connecting piece (511) is arranged on one side of the main body (51), the tail of the spring bar (11) is fixedly connected with the connecting piece (511) and an accommodating cavity is arranged on another side of the main body (51);

a second adjusting core (52), wherein one part of the second adjusting core (52) is located in the accommodating cavity of the main body (51);

a sealing cover (53) which is provided with a through hole, wherein said one part of the second adjusting core (52) penetrates through the through hole and is hermetically installed in the accommodating cavity;

a second rotating plug (54) which is provided with a penetrating hole, wherein another part of the second adjusting core (52) that extends from the accommodating cavity penetrates through the penetrating hole through a bolt and is connected with the second rotating plug (54); a cylindrical positioning component (541) is arranged in the second rotating plug (54); the positioning component (541) is provided with a positioning groove (542); and an outer wall of the second rotating plug (54) is in interference fit with the scroll;

a torsion spring (55) sleeved on an outer side of the second adjusting core (52), wherein an end of the torsion spring is provided with a lead-out part (551) clamped in the positioning groove (542) of the second rotating plug (54).

10. The pre-loadable spring roller blind according to claim 8, wherein the left bracket (3) is provided with a positioning column (31); the head of the spring bar (11) is provided with a positioning groove (113); and the positioning column (31) is inserted into the positioning groove (113) for preventing the spring bar (11) from rotating.

* * * * *